US011703899B2

(12) United States Patent
Hsu et al.

(10) Patent No.: US 11,703,899 B2
(45) Date of Patent: Jul. 18, 2023

(54) VOLTAGE REGULATOR

(71) Applicant: ALi Corporation, Hsinchu (TW)

(72) Inventors: Chih-Yuan Hsu, Hsinchu (TW); Andrew Yang Lee, Taipei (TW)

(73) Assignee: ALi Corporation, Hsinchu (TW)

( * ) Notice: Subject to any disclaimer, the term of this patent is extended or adjusted under 35 U.S.C. 154(b) by 0 days.

(21) Appl. No.: 17/493,851

(22) Filed: Oct. 5, 2021

(65) Prior Publication Data

US 2022/0147084 A1 May 12, 2022

(30) Foreign Application Priority Data

Nov. 9, 2020 (CN) ..... 202011237150.6

(51) Int. Cl.
*G05F 1/575* (2006.01)
*G05F 1/44* (2006.01)
*G05F 1/46* (2006.01)

(52) U.S. Cl.
CPC ..... *G05F 1/575* (2013.01); *G05F 1/44* (2013.01); *G05F 1/468* (2013.01)

(58) Field of Classification Search
CPC . G05F 1/575; G05F 1/44; G05F 1/468; G05F 1/573; G05F 1/5735
See application file for complete search history.

(56) References Cited

U.S. PATENT DOCUMENTS 8,710,813 B2 * 4/2014 Yang ..... G05F 1/575 323/275
2004/0257053 A1 * 12/2004 Okubo ..... H03K 17/145 323/234
2013/0285630 A1 * 10/2013 Wang ..... G05F 1/562 323/275

* cited by examiner

*Primary Examiner* — Nguyen Tran
(74) *Attorney, Agent, or Firm* — JCIPRNET

(57) ABSTRACT

A voltage regulator, including an amplifier, a voltage setting circuit and a power transistor, is provided. The amplifier includes a first current source and a second current source. The amplifier has two input terminals to respectively receive a reference voltage and a feedback voltage. The first current source is coupled between the operating power source and an output terminal of the amplifier, and provides a first current to the output terminal. The second current source is coupled between the output terminal and a reference ground terminal, and draws a second current from the output terminal. The voltage setting circuit is coupled to the output terminal, and increases a driving voltage on the output terminal according to the first current in a voltage bypass mode. The power transistor receives the driving voltage and generates an output voltage according to the driving voltage based on the operating power source.

10 Claims, 2 Drawing Sheets

VOLTAGE REGULATOR

CROSS-REFERENCE TO RELATED APPLICATION

This application claims the priority benefit of China application serial no. 202011237150.6, filed on Nov. 9, 2020. The entirety of the above-mentioned patent application is hereby incorporated by reference herein and made a part of this specification.

BACKGROUND

Technical Field

This disclosure relates to a voltage regulator, and in particular to a voltage regulator that is configured to switch between a normal mode and a voltage bypass mode.

Description of Related Art

Currently, in the related art, a low-voltage voltage regulator needs to switch between a normal mode and a voltage bypass mode, and the voltage regulator generates an output voltage that is substantially equal to the operating power source in the voltage bypass mode. In order to achieve this, the related art detects the level of the output voltage to correspondingly adjust the output voltage to a required level through disposition of an analog-to-digital conversion circuit. As a result, since the analog-to-digital conversion circuit needs to take up a large amount of circuit area, and requires a complex detection and compensation mechanism, the circuit cost and power consumption are increased.

SUMMARY

This disclosure provides a voltage regulator that is configured to output an output voltage that is substantially equal to an operating power source in a voltage bypass mode.

According to an embodiment of the disclosure, the voltage regulator includes an amplifier, a voltage setting circuit, and a power transistor. The amplifier includes a first current source and a second current source. The amplifier has two input terminals to respectively receive a reference voltage and a feedback voltage. The first current source is coupled between an operating power source and an output terminal of the amplifier, and provides a first current to the output terminal of the amplifier. The second current source is coupled between the output terminal of the amplifier and a reference ground terminal, and draws a second current from the output terminal of the amplifier. The voltage setting circuit is coupled to the output terminal of the amplifier, and sets a driving voltage on the output terminal according to the first current in a voltage bypass mode. The power transistor receives the driving voltage and generates an output voltage according to the driving voltage based on the operating power source.

Based on the above, the embodiment of the disclosure uses the voltage setting circuit to increase the driving voltage generated on the output terminal of the amplifier in the voltage bypass mode, so as to enable the power transistor to provide a sufficiently low conduction resistance, and to enable the voltage regulator to provide the output voltage that is equal to the operating power source.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the descriptions, serve to explain the principles of the disclosure.

DESCRIPTION OF THE EMBODIMENTS

Figure 1:
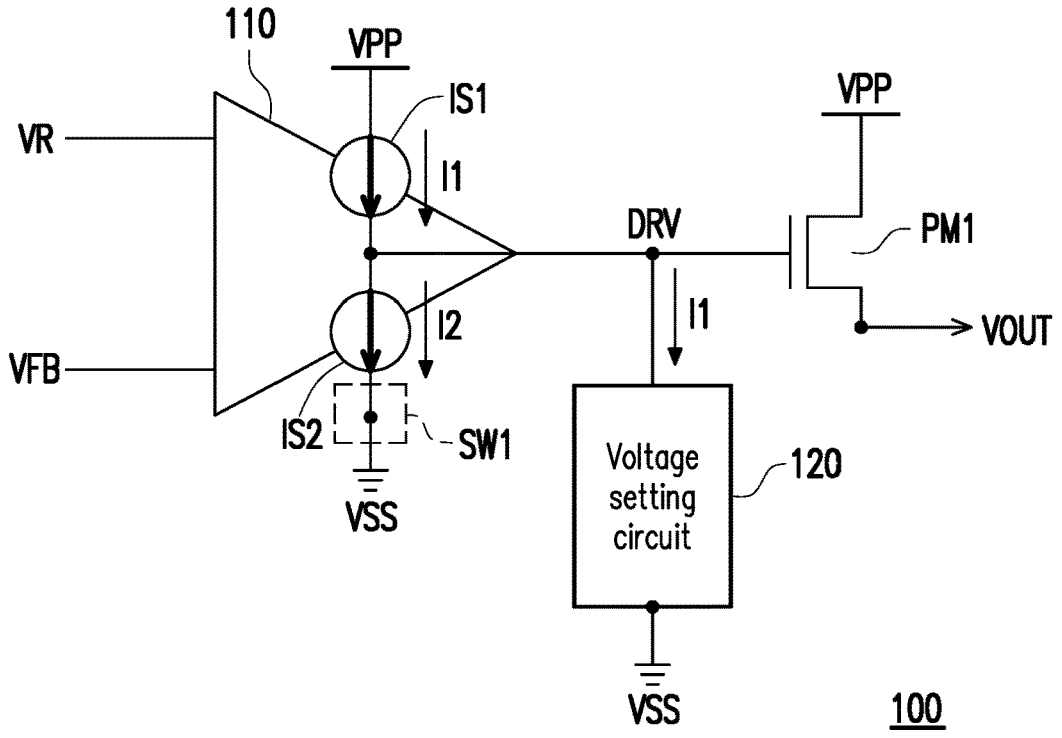
FIG. 1 is a schematic diagram of a voltage regulator according to an embodiment of the disclosure.

Reference will now be made in detail to the exemplary embodiments of the disclosure, and examples of the exemplary embodiments are illustrated in the accompanying drawings. Whenever possible, the same reference numerals are used in the drawings and descriptions to represent the same or similar parts.

FIG. 1 is a schematic diagram of a voltage regulator according to an embodiment of the disclosure. With reference to FIG. 1, a voltage regulator 100 includes an amplifier 110, a voltage setting circuit 120, and a power transistor PM1. The amplifier 110 has two input terminals to respectively receive a reference voltage VR and a feedback voltage VFB. The amplifier 110 may receive the reference voltage VR through a positive input terminal and receive the feedback voltage VFB through a negative input terminal. The amplifier 110 further has current sources IS1 and IS2. The current source IS1 is coupled between an operating power source VPP and an output terminal of the amplifier 110, and is configured to provide a first current I1 to the output terminal of the amplifier 110. The current source IS2 is coupled between the output terminal of the amplifier 110 and a reference ground terminal VSS, and is configured to draw a second current I2 from the output terminal of the amplifier 110. In addition, a switch SW1 may be disposed on a path coupling the current source IS2 to the reference ground terminal VSS.

The voltage setting circuit 120 is coupled between the output terminal of the amplifier 110 and the reference ground terminal VSS. The voltage setting circuit 120 is enabled when the voltage regulator 100 is working in a voltage bypass mode. In the voltage bypass mode, the voltage setting circuit 120 may receive the first current I1 and increase a driving voltage DRV on the output terminal of the amplifier 110 according to the first current I1.

A terminal of the power transistor PM1 receives the operating power source VPP, while another terminal of the power transistor PM1 generates an output voltage VOUT. A control terminal of the power transistor PM1 is coupled to the output terminal of the amplifier 110 to receive the driving voltage DRV. In the embodiment, the power transistor PM1 is a P-type transistor.

In terms of action details, the voltage regulator 100 may work in a normal mode or the voltage bypass mode. When the voltage regulator 100 is in the normal mode, it is configured as a low drop-out (LDO) voltage regulator and generates the output voltage VOUT that is lower than the operating power source VPP according to the reference voltage VR. In the normal mode, the switch SW1 is conductive, and the voltage setting circuit 120 is not enabled. The amplifier 110 may enable the current sources IS1 or IS2 to generate the first current I1 or the second current I2 according to comparison between the reference voltage VR and the feedback voltage VFB. In addition, the driving voltage DRV is increased according to the first current I1, or pulled down according to the second current I2.

In addition, in the voltage bypass mode, the switch SW1 is disconnected, and the voltage setting circuit 120 is enabled. In this case, the current source IS2 stops generating the second current I2, and the first current I1 generated by the current source IS1 may flow to the voltage setting circuit 120. Then the voltage setting circuit 120 may set a level of the driving voltage DRV on the output terminal of the amplifier 110 to be provided to the power transistor PM1 through the received first current I1, and enable the power transistor PM1 to provide an extremely low conduction resistance. In the embodiment, the voltage setting circuit 120 may pull low the level of the driving voltage DRV to become, for example, a reference ground voltage in the voltage bypass mode, and enable the conduction resistance of the power transistor PM1 to be extremely low. In this case, the power transistor PM1 may provide the operating power source VPP to generate the output voltage VOUT. In addition, under the condition of the conduction resistance of the power transistor PM1 being extremely low, the output voltage VOUT is substantially equal to the operating power source VPP. In fact, the output voltage VOUT is slightly lower than the operating power source VPP. A voltage difference between the output voltage VOUT and the operating power source VPP may be determined according to the conduction resistance and current flow of the power transistor PM1. It is worth noting that at this time, the power transistor PM1 operates in a linear region.

Figure 2:
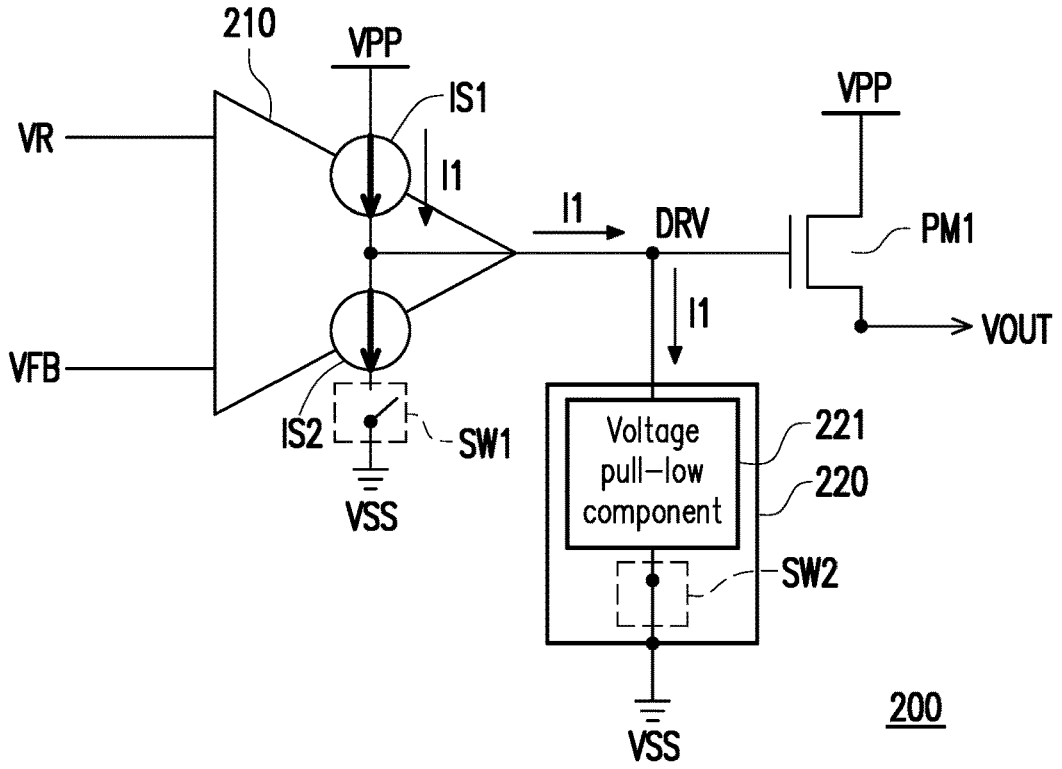
FIG. 2 is a schematic diagram of a voltage regulator according to another embodiment of the disclosure.

FIG. 2 is a schematic diagram of a voltage regulator according to another embodiment of the disclosure. With reference to FIG. 2, a voltage regulator 200 includes an amplifier 210, a voltage setting circuit 220, and the power transistor PM1. The voltage setting circuit 220 includes a voltage pull-low component 221 and a switch SW2. The voltage pull-low component 221 and the switch SW2 are coupled in series between an output terminal of the amplifier 210 and the reference ground terminal VSS, and the voltage pull-low component 221 is configured to provide a default impedance. When the voltage regulator 200 is working in the normal mode, the switch SW2 is disconnected and the voltage setting circuit 220 is not enabled accordingly. On the other hand, when the voltage regulator 200 is working in the voltage bypass mode, the switch SW2 is conductive, the voltage setting circuit 220 is enabled, and the voltage pull-low component 221 may receive the first current I1 provided by the current source IS1 and pull low the driving voltage DRV according to the first current I1 and the default impedance. The power transistor PM1 may be conductive through the pulled low driving voltage DRV, and provides an extremely low conduction resistance. In this way, the power transistor PM1 may generate the output voltage VOUT that is substantially equal to the operating power source VPP.

Please note that the switch SW1 is conductive in the normal mode and disconnected in the voltage bypass mode. The switch SW2 is disconnected in the normal mode, but it is conductive in the voltage bypass mode. In other words, the actions of the switches SW1 and SW2 are complementary.

Figures 3A, 3B, 3C, 3D:
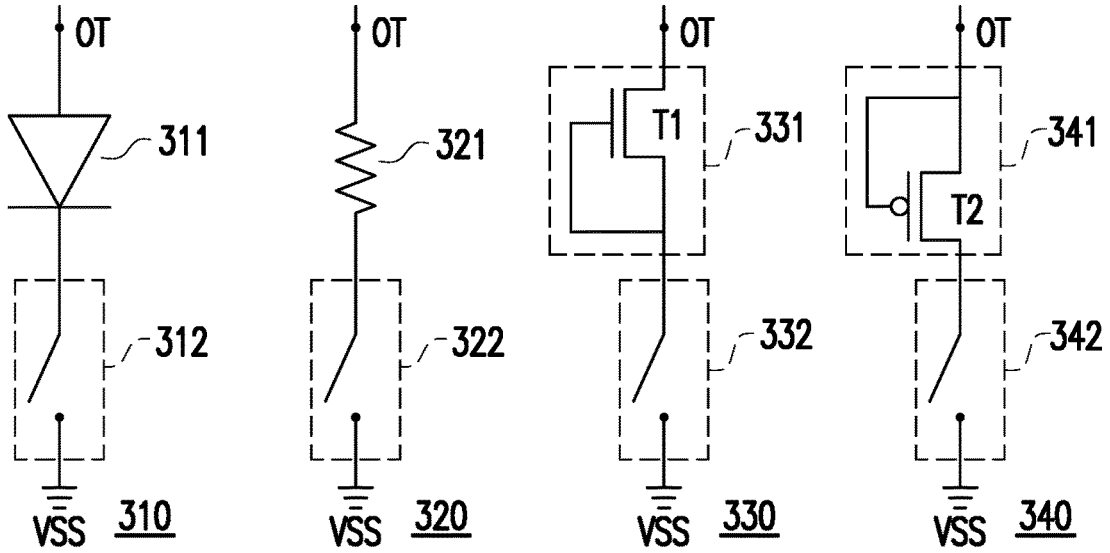
FIGS. 3A to 3D are schematic diagrams of multiple implementation manners of a voltage setting circuit according to an embodiment of the disclosure.

Reference may be made to FIGS. 3A to 3D for implementation manners of the voltage pull-low component. FIGS. 3A to 3D are schematic diagrams of the multiple implementation manners of the voltage setting circuit according to an embodiment of the disclosure. In FIG. 3A, the voltage setting circuit 310 is composed of a diode 311 and a switch 312 coupled in series. The anode of the diode 311 is coupled to an output terminal OT of the amplifier, and the switch 312 may be coupled between the cathode of the diode 311 and the reference ground terminal VSS. The diode 311 is configured to construct the voltage pull-low component. In the voltage bypass mode, the switch 312 is conductive, and the diode 311 is conductive accordingly, and a voltage on the output terminal OT is pulled low according to a current received by the output terminal OT. In the embodiment, the number of the diode 311 is not limited to one, for example, multiple diodes 311 may be connected in series. In addition, positions of the diode 311 and the switch 322 in FIG. 3A may also be interchanged in other embodiments, and is not limited thereto.

The switch 312 may be implemented by any switch component well known to a person with ordinary knowledge in the art, without any specific limitation.

In FIG. 3B, a voltage setting circuit 320 is composed of a resistor 321 and a switch 322 coupled in series. The resistor 321 is configured to construct the voltage pull-low component. In the voltage bypass mode, the switch 322 is conductive. The resistor 321 may receive the first current from the output terminal OT of the amplifier and push up the voltage on the output terminal OT. In the embodiment, the resistor 321 may be formed of any material that may be used as a resistor in an integrated circuit, such as a polysilicon layer, a well region, and/or a metal layer, without any specific limitation. Alternatively, the resistor 321 may also be formed by any circuit component, such as a transistor biased in the linear region.

In FIG. 3C, a voltage setting circuit 330 is composed of a transistor T1 and a switch 332 coupled in series. The transistor T1 is coupled into a diode configuration and forms a voltage pull-low component 331. In the embodiment, the transistor T1 is a P-type transistor. An action manner of the voltage setting circuit 330 is the same as that of the voltage setting circuit 310, which will not be reiterated here.

In FIG. 3D, a voltage setting circuit 340 is composed of a transistor T2 and a switch 342 coupled in series. The transistor T2 is coupled into the diode configuration and forms a voltage pull-low component 341. In the embodiment, the transistor T2 is an N-type transistor. An action manner of the voltage setting circuit 340 is the same as that of the voltage setting circuit 310, which will not be reiterated here.

Incidentally, the transistors T1 and T2 in FIGS. 3C and 3D do not necessarily need to be coupled into the diode configuration. In other embodiments of the disclosure, gates of the transistors T1 and T2 may also enable the transistors T1 and T2 to be equivalent to a resistor through receiving different bias voltages. In this way, the voltage setting circuits 330 and 340 may perform the same operation as the voltage setting circuit 320.

Figure 4:
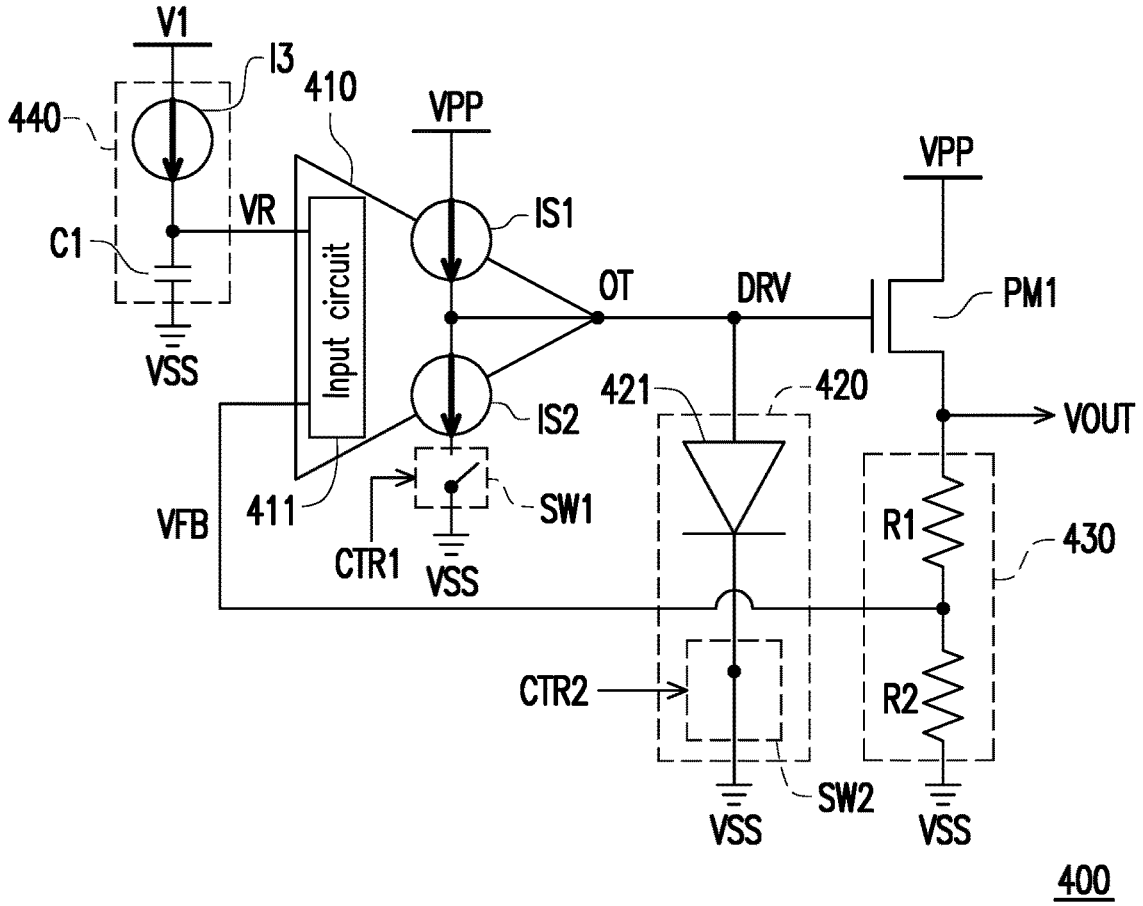
FIG. 4 is a schematic diagram of a voltage regulator according to yet another embodiment of the disclosure.

FIG. 4 is a schematic diagram of a voltage regulator according to yet another embodiment of the disclosure. With reference to FIG. 4, a voltage regulator 400 includes an amplifier 410, a voltage setting circuit 420, the power transistor PM1, a feedback circuit 430, and a reference voltage generator 440. The amplifier 410 has the current sources IS1 and IS2, the switch SW1, and has an input circuit 411. The switch SW1 is controlled by a control signal CTR1. The control signal CTR1 may be generated according to whether the voltage regulator 400 is operating in the normal mode or the voltage bypass mode. The switch SW1 is conductive according to the control signal CTR1 when the voltage regulator 400 is working in the normal mode and the switch SW1 is disconnected when the voltage regulator 400 is working in the voltage bypass mode. In addition, the amplifier 410 may receive the reference voltage VR and the feedback voltage VFB through the input circuit 411 when the voltage regulator 400 is working in the normal mode, and generate the driving voltage DRV at the output terminal OT according to the comparison between the reference voltage VR and the feedback voltage VFB. The voltage regulator 400 ignores the reference voltage VR and the feedback voltage VFB when the voltage regulator 400 is working in the voltage bypass mode, and directly outputs the output voltage VOUT that is substantially equal to the operating power source VPP. Therefore, the input circuit 411 does not need to work and may be switched off, so as to further reduce the required power consumption.

The voltage setting circuit 420 includes a voltage pull-low component 421 and the switch SW2. The voltage pull-low component 421 and the switch SW2 are connected in series between the output terminal OT of the amplifier 410 and the reference ground terminal VSS. In the embodiment, the voltage pull-low component 421 is a diode. The switch SW2 is controlled by a control signal CTR2. Similarly, the control signal CTR2 may be generated according to whether the voltage regulator 400 is operating in the normal mode or the voltage bypass mode. The conductive or disconnected states of the switches SW1 and SW2 are complementary.

In the embodiment, whether the voltage regulator 400 works in the normal mode or the voltage bypass mode may be determined through an external command. In other words, the control signals CTR1 and CTR2 may be generated according to the external command.

The feedback circuit 430 includes resistors R1 and R2. The resistors R1 and R2 are connected in series between the power transistor PM1 and the reference ground terminal VSS. The feedback circuit 430 is configured to divide the output voltage VOUT generated by the power transistor PM1 to generate the feedback voltage VFB in the normal mode. Based on the feedback voltage VFB only needs to be generated in the normal mode, therefore in other embodiments of the disclosure, a switch may be disposed to be connected in series with a resistor formed by the resistors R1 and R2, so that a path between the transistor PM1 and the reference ground terminal VSS is disconnected when the voltage regulator 400 is working in the voltage bypass mode, which effectively reduce a possible direct current leakage path between the transistor PM1 and the reference ground terminal VSS.

In addition, in the embodiment, the reference voltage generator 440 is configured to provide the reference voltage VR. The reference voltage generator 440 includes a current source I3 and a capacitance C1. The current source I3 and the capacitance C1 are coupled between the voltage V1 and the reference ground terminal VSS. The reference voltage VR may gradually rise to a level equal to the voltage V1 according to a charging action of the capacitance C1 when the reference voltage VR is started. In this way, the provision of the reference voltage VR may be enabled to have a soft start effect.

In other embodiments of the disclosure, the reference voltage VR may also be provided through a band gap voltage generating circuit.

Incidentally, according to the embodiment of the disclosure, the voltage regulator 400 may dynamically switch between the normal mode and the voltage bypass mode and enable the output voltage VOUT generated by the voltage regulator 400 to switch between being equal to the operating power source VPP (for example, 5 volts) and being lower than the operating power source VPP (for example, 3 volts) according to actual needs.

According to the above description, the disclosure provides the voltage setting circuit to reduce the conduction resistance of the power transistor by pulling low the driving voltage received by the power transistor in the voltage bypass mode, and enabling the voltage regulator to effectively generate the output voltage that is substantially equal to the operating power source. The disclosure effectively constructs the voltage regulator that can dynamically switch between the voltage bypass mode and the normal mode without greatly increasing the circuit area according to the existing voltage regulator structure, and improve its work efficacy by a simple disposition of the voltage setting circuit.

Finally, it should be noted that the above embodiments are only used to illustrate the technical solutions of the disclosure, and not meant to be limiting. Although the disclosure has been described in detail with reference to the foregoing embodiments, a person of ordinary skill in the art should understand that modifications may be made to the technical solutions described in the foregoing embodiments, or some or all of the technical features may be equivalently replaced. However, these modifications or replacements do not cause the spirit of the corresponding technical solutions to deviate from the scope of the technical solutions of the embodiments of the disclosure. Accordingly, the scope of the disclosure is defined by the claims appended hereto and their equivalents in which all terms are meant in their broadest reasonable sense unless otherwise indicated.

What is claimed is:

1. A voltage regulator, comprising:

an amplifier, having two input terminals to respectively receive a reference voltage and a feedback voltage, wherein the amplifier comprises:

a first current source coupled between an operating power source and an output terminal of the amplifier to provide a first current to the output terminal; and a second current source coupled between the output terminal and a reference ground terminal to draw a second current from the output terminal;

a voltage setting circuit, coupled to the output terminal, wherein the voltage setting circuit sets a driving voltage on the output terminal according to the first current in a voltage bypass mode; and a power transistor, wherein the power transistor receives the driving voltage and generates an output voltage according to the driving voltage based on the operating power source, wherein the second current source stops drawing the second current from the output terminal in the voltage bypass mode.

2. The voltage regulator according to claim 1, wherein the output voltage is substantially equal to the operating power source in the voltage bypass mode.

3. The voltage regulator according to claim 1, wherein the voltage setting circuit stops receiving the first current in a normal mode.

4. The voltage regulator according to claim 2, wherein the voltage setting circuit comprises:

a voltage pull-low component coupled to the output terminal; and a switch coupled between the output terminal and the reference ground terminal with the voltage pull-low component, wherein the switch is conductive in the voltage bypass mode and the switch is disconnected in a normal mode.

5. The voltage regulator according to claim 4, wherein the voltage pull-low component is a diode, a resistor or a transistor.

6. The voltage regulator according to claim 1, further comprising:

a feedback circuit coupled to a coupling path between the power transistor and the reference ground terminal, wherein the feedback circuit generates the feedback voltage according to division of the output voltage.

7. The voltage regulator according to claim 1, wherein the amplifier further comprises an input circuit, and the input circuit stops working in the voltage bypass mode.

8. The voltage regulator according to claim 1, wherein the power transistor works in a linear region in the voltage bypass mode.

9. The voltage regulator according to claim 1, further comprising:

a reference voltage generator, wherein the reference voltage generator comprises:

a third current source to provide a third current; and a capacitance coupled between the third current source and the reference ground terminal to generate the reference voltage according to the third current.

10. A voltage regulator, comprising:

an amplifier having two input terminals and an output terminal, wherein the two input terminals of the amplifier respectively receive a reference voltage and a feedback voltage generated from an output voltage, wherein the amplifier comprises:

a first current source coupled between an operating power source and an output terminal; and a second current source coupled between the output terminal and a reference ground terminal;

a voltage setting circuit coupled to the output terminal, wherein the voltage setting circuit sets a driving voltage on the output terminal; and a power transistor, wherein the power transistor receives the driving voltage and generates the output voltage according to the driving voltage;

wherein in response to an operation mode of the voltage regulator, the voltage setting circuit sets the driving voltage on the output terminal according to a first current to the output terminal provided by the first current source with the second current source stopping drawing a second current from the output terminal.

* * * * *